US009894972B2

(12) United States Patent
Davis

(10) Patent No.: US 9,894,972 B2
(45) Date of Patent: Feb. 20, 2018

(54) LUGGAGE ITEMS WITH EXPANDABILITY

(71) Applicant: Eagle Creek, Carlsbad, CA (US)

(72) Inventor: Mark Davis, Carlsbad, CA (US)

(73) Assignee: Eagle Creek, Carlsbad, CA (US)

( * ) Notice: Subject to any disclaimer, the term of this patent is extended or adjusted under 35 U.S.C. 154(b) by 0 days.

(21) Appl. No.: 14/066,463

(22) Filed: Oct. 29, 2013

(65) Prior Publication Data

US 2014/0116829 A1 May 1, 2014

Related U.S. Application Data

(60) Provisional application No. 61/721,361, filed on Nov. 1, 2012.

(51) Int. Cl.

| | |
|---|---|
| ***A45C 7/00*** | (2006.01) |
| *A45C 5/14* | (2006.01) |
| *A45F 3/04* | (2006.01) |
| *A45C 9/00* | (2006.01) |

(52) U.S. Cl.

CPC ..... *A45C 7/0022* (2013.01); *A45C 7/0045* (2013.01); *A45C 5/14* (2013.01); *A45C 2009/007* (2013.01); *A45F 3/04* (2013.01); *Y10T 29/49877* (2015.01)

(58) Field of Classification Search

CPC ..... A45C 7/00; A45C 7/005; A45C 7/0045; A45C 7/0059; A45C 7/0072; A45C 7/0036

USPC ..... 190/103, 108, 903, 119, 122, 123, 24, 190/127, 104, 105, 107, 110; 393/2.33

See application file for complete search history.

(56) References Cited

U.S. PATENT DOCUMENTS 892,125 A * 6/1908 Bourne ..... A45C 7/0031 190/104
1,460,016 A * 6/1923 Emery ..... 190/19
1,786,775 A * 12/1930 Paterson ..... B21B 13/04 29/17.4
1,950,118 A * 3/1934 Lifton ..... A45C 5/03 190/103

(Continued)

FOREIGN PATENT DOCUMENTS

FR 2573635 A1 * 5/1986
FR 2626753 * 8/1989

(Continued)

OTHER PUBLICATIONS

In't Search Authority/US, International Search Report and Written Opinion for PCT Application No. PCT/US2014/056812, Publication No. WO 2015/047956, dated Mar. 13, 2015, pp. 28.

*Primary Examiner* — Sue A Weaver
(74) *Attorney, Agent, or Firm* — Ganz Pollard, LLC

(57) ABSTRACT

An item of luggage, comprising: a plurality of sides sufficient to define a first volumetric space, an expandable section disposed within the space between first and second opposing sides, wherein at least the first opposing side defines a boundary for the volumetric space and provides an exterior surface for the item of luggage; the expandable section having a first configuration wherein it is stored within the space and has an expandable side that is adjacent to the first opposing side, and a second configuration wherein the expandable side extends a predetermined distance from the first opposing side to define a boundary for a second volumetric space that is the same as or different from the first volumetric space.

24 Claims, 12 Drawing Sheets

(56) References Cited

U.S. PATENT DOCUMENTS 2,078,624 A * 4/1937 Wolff ..... 383/2
2,087,951 A * 7/1937 Jarvis ..... 206/542
2,212,390 A * 8/1940 Conklin ..... 383/2
2,536,169 A * 1/1951 Gray ..... A45C 3/00 190/103
2,729,257 A * 1/1956 Kepper ..... 383/2
3,061,057 A * 10/1962 Miller ..... A45C 7/0086 190/110
3,122,225 A * 2/1964 Ward ..... 190/108
3,340,969 A * 9/1967 Rothberg ..... 190/1
3,443,671 A * 5/1969 Dyke ..... 190/103
4,081,061 A 3/1978 Tucker
4,106,598 A * 8/1978 Davis ..... 190/111
4,153,146 A * 5/1979 Patton et al. ..... 190/103
4,236,615 A * 12/1980 Ginat ..... 190/111
4,437,549 A * 3/1984 Gibbs ..... 190/109
4,655,329 A * 4/1987 Kaneko ..... A45C 7/0036 190/107
4,718,278 A * 1/1988 Bergsma ..... G01L 9/0057 338/42
4,756,394 A * 7/1988 Cohen ..... 190/18 A
4,763,763 A * 8/1988 Sadow ..... 190/115
4,773,515 A * 9/1988 Kotkins, Jr. ..... 190/103
4,787,488 A * 11/1988 Campanini ..... 190/104
4,979,598 A * 12/1990 Verheij et al. ..... 190/18 A
5,240,106 A 8/1993 Plath
5,307,908 A 5/1994 Shyr et al.
5,358,082 A 10/1994 Armstrong
5,413,199 A * 5/1995 Clement ..... 190/108
5,427,453 A * 6/1995 Cloessner ..... 383/38
5,547,052 A 8/1996 Latshaw
5,560,479 A * 10/1996 Leyba et al. ..... 206/315.5
5,671,831 A * 9/1997 Chiu ..... 190/103
5,678,666 A * 10/1997 Shyr et al. ..... 190/102
5,749,503 A * 5/1998 Wulf et al. ..... 224/153
5,875,876 A * 3/1999 Wang ..... 190/18 A
6,050,374 A * 4/2000 Johnston ..... 190/109
6,213,267 B1 4/2001 Miller
6,244,399 B1 * 6/2001 Birkestrand ..... A45C 5/14 190/103
6,382,376 B1 5/2002 Rosen et al.
6,467,594 B1 * 10/2002 Wu ..... 190/108
6,533,087 B1 * 3/2003 Chen ..... A45C 7/0022 190/103
6,550,651 B1 4/2003 Murdoch et al.
6,637,633 B1 * 10/2003 Eberle ..... 224/582
7,232,018 B1 * 6/2007 Salander ..... 190/108
7,594,569 B2 9/2009 Bass et al.
7,641,030 B2 1/2010 Selvi
7,665,642 B2 * 2/2010 Abbate ..... 224/585
2002/0130004 A1 * 9/2002 Lin ..... A45C 7/0022 190/103
2004/0238303 A1 12/2004 Hafif
2005/0156002 A1 7/2005 Neal et al.
2006/0102673 A1 * 5/2006 Collier ..... 224/581
2010/0006459 A1 * 1/2010 Foley ..... 206/279
2010/0320048 A1 * 12/2010 Clamy Boccard ..... 190/18 A
2011/0174583 A1 * 7/2011 Yoneno ..... A45C 5/14 190/103
2013/0140120 A1 * 6/2013 Rasmussen ..... 190/109

FOREIGN PATENT DOCUMENTS

FR 2626753 A1 * 8/1989
FR 2874796 A1 * 3/2006
GB 2080220 A * 2/1982
GB 2184940 A * 7/1987 ..... A45C 7/0036
WO WO 2007067574 A2 * 6/2007

* cited by examiner

LUGGAGE ITEMS WITH EXPANDABILITY

RELATED APPLICATIONS

This application claims the benefit of and priority to U.S. Provisional Application Ser. No. 61/721,361, filed Nov. 1, 2012, the contents of which are hereby incorporated by reference as if recited in full herein for all purposes.

BACKGROUND

The inventive subject matter is generally directed to items of luggage, including suitcases, backpacks, travel packs, carry-ons, duffel bags, brief cases, travel cases, and gear bags. More particularly, the inventive subject matter is directed to luggage items with an expandable section to selectively increase the volume of the item and hence the carrying capacity. In some embodiments, the inventive subject matter is directed to a modular luggage system where one item of luggage removably couples to a main item of luggage with the expandable section.

One patent of interest, U.S. Pat. No. 7,594,569 in the name of The North Face, shows a small backpack that is zippered to the face of a larger backpack. When the small backpack is detached, a set of pockets is exposed on the supporting face of the larger backpack. The face of the larger backpack includes a stowable cover that can be pulled out to cover the pockets and the area that was occupied by the detached backpack.

Other such modular systems show detachable backpacks or similar carriers on the face of an item of luggage or expandable sections in an item of luggage.

In present day travel, many travelers prefer to avoid the hassles and extra costs associated with traveling with multiple items of luggage. Travelers also prefer not to travel with unnecessarily bulky luggage items. At the same time, travelers may acquire items during the course of trip or may reduce the number of items they initially started with. Accordingly, a significant need exists for luggage items and systems that adaptably adjust capacity to the needs of a traveler.

SUMMARY

The inventive subject matter in its various embodiments overcomes the aforementioned disadvantages in the prior art by providing a novel expandable luggage system. The system allows for modularity, as well as expandability.

In certain general embodiments, the inventive subject matter is directed to an item of luggage, comprising: a plurality of sides sufficient to define a first volumetric space, an expandable section disposed within the space between first and second opposing sides, wherein at least the first opposing side defines a boundary for the volumetric space and provides an exterior surface for the item of luggage; and the expandable section having a first configuration wherein it is stored within the space and has an expandable side that is adjacent to the first opposing side, and a second configuration wherein the expandable side extends a predetermined distance from the first opposing side to define a boundary for a second volumetric space that is the same as or different from the first volumetric space.

In any of the embodiments contemplated herein, the second opposing side may be removable and the expandable side may be extendable to provide the corresponding exterior side of the item of luggage and to define a generally planar boundary for the second volumetric space.

In any of the embodiments contemplated herein, the expandable section may be configured to expand beyond the boundary of the second opposing side so as to define a second volumetric space that is greater than the first volumetric space.

In any of the embodiments contemplated herein, the luggage item may consist of a modular set of luggage items comprising a main item and a removable item, and the second opposing side may consist of a side of a removable item of luggage.

In any of the embodiments contemplated herein, the removable item of luggage may be the smaller of the items and includes at least one shoulder strap.

In any of the embodiments contemplated herein, the removable item includes two backpack straps.

In any of the embodiments contemplated herein, the expandable section may be made of a flexible material.

In any of the embodiments contemplated herein, the luggage item may include a stay system, or other support mechanisms, that supports the expandable section in a desired form.

In any of the embodiments contemplated herein, the stay system may extend into the second volumetric space and supports the expandable section in an intended configuration defining the second volumetric space.

In any of the embodiments contemplated herein, the second volumetric space may be from about 25% to about 200% or greater that than the first volumetric space.

In any of the embodiments contemplated herein, the removable pack may attach to the main item via a zipper, or other inter-engaging parts.

In any of the embodiments contemplated herein, the volumetric space may be defined by two or more sides of the main luggage item and a surface of the second opposing side.

In any of the embodiments contemplated herein, the luggage item may consist of a modular set of luggage items comprising a main item and a removable item, and the first opposing side is a side of the main item and the second opposing side comprises a side of a removable item of luggage.

In any of the embodiments contemplated herein, the first opposing side and at least one other side of the main item may define a volumetric space for the main item, and the surface of the second opposing side is partly or fully recessed into the volumetric space for the main item.

In any of the embodiments contemplated herein, the surface of the second opposing side may be disposed above the compartment of the main luggage item so as to provide a total volumetric space for the combined main item and removable item that is greater than the volumetric space of the main luggage item.

The inventive subject matter is also directed to a method of making a luggage item according to any of claims comprising providing a main luggage item with an expandable section that is stored in a compartment of the main luggage item.

These and other embodiments are described in more detail in the following detailed descriptions and the Figures.

The foregoing is not intended to be an exhaustive list of embodiments and features of the inventive subject matter. Persons skilled in the art are capable of appreciating other embodiments and features from the following detailed description in conjunction with the drawings.

The following is a description of various inventive lines under the inventive subject matter. The appended claims, as originally filed in this document and the above-referenced provisional patent application, or as subsequently amended, are hereby incorporated into this Summary section as if written directly in.

BRIEF DESCRIPTION OF THE DRAWINGS

The accompanying Figures show representative embodiments according to the inventive subject matter, unless noted as showing prior art.

DETAILED DESCRIPTION

Figure 1:
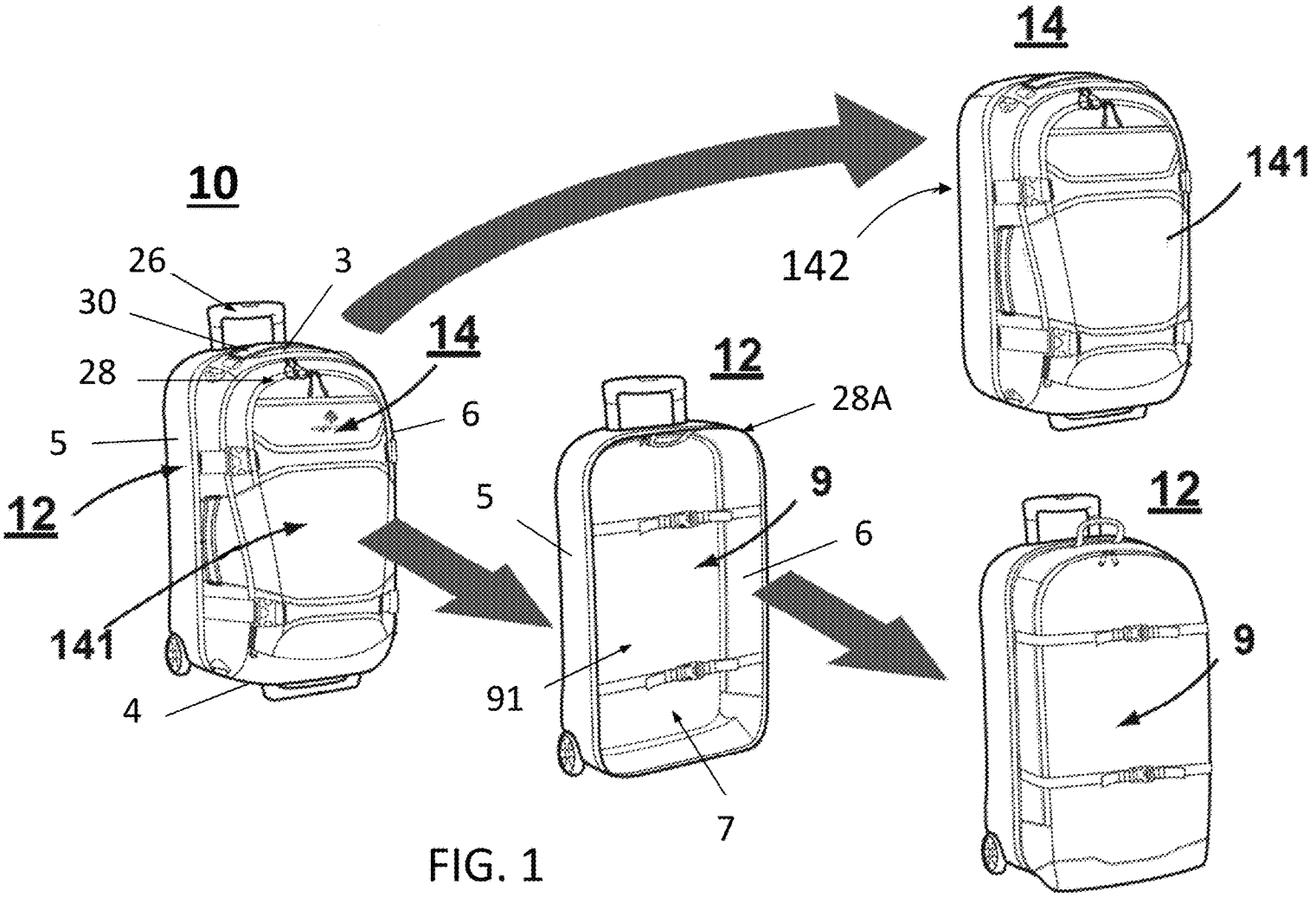
FIG. 1 shows front, left perspective views of a modular assembly of a main luggage item and a removable item coupled to the main luggage item, with the top arrow pointing to the removable item after being decoupled from the main item and the lower arrows indicating possible configurations of the main item following the decoupling of the main item.
Figure 4:
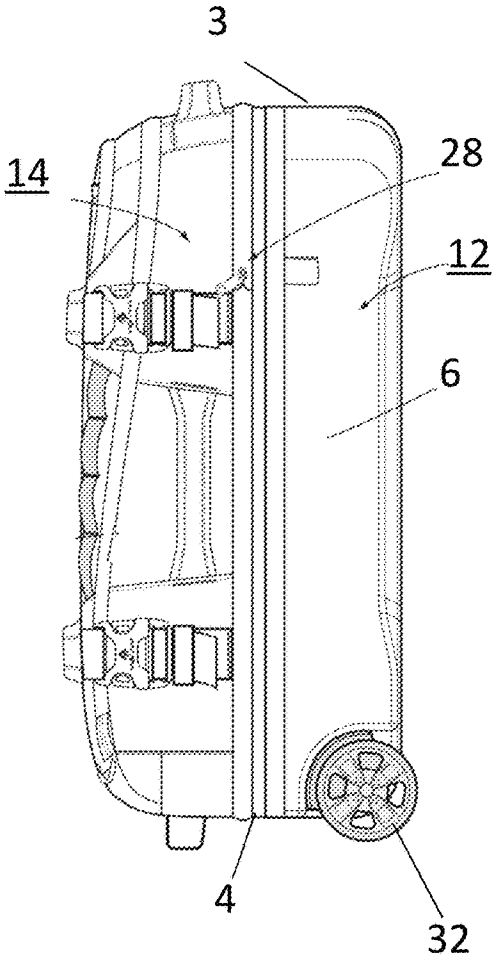
FIG. 4 shows a right side view of the general assembly of FIG. 1.
Figure 3:
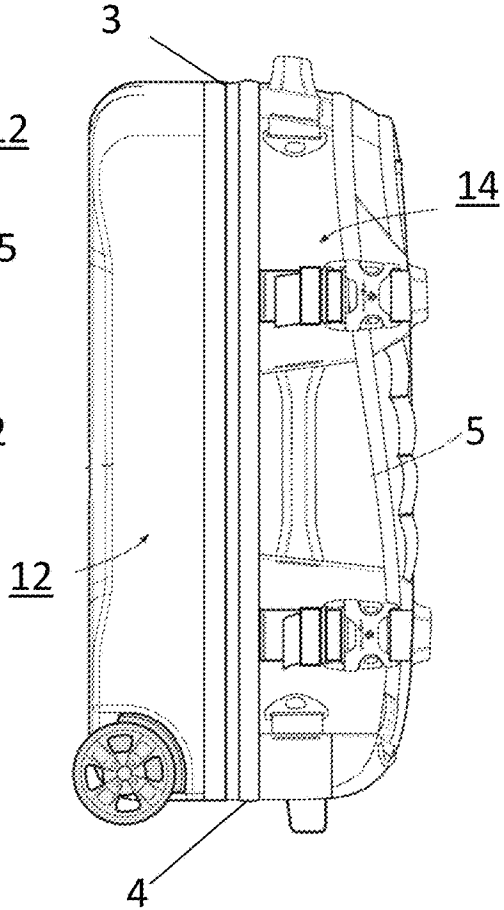
FIG. 3 shows a left side view of the general assembly of FIG. 1.
Figure 2:
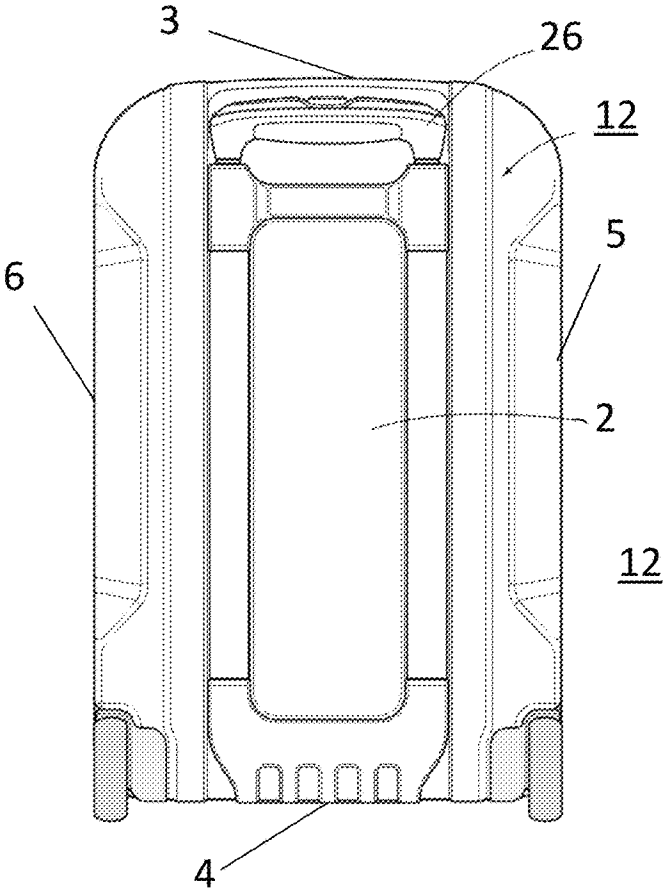
FIG. 2 shows a back side view of the general assembly of FIG. 1.
Figure 6:
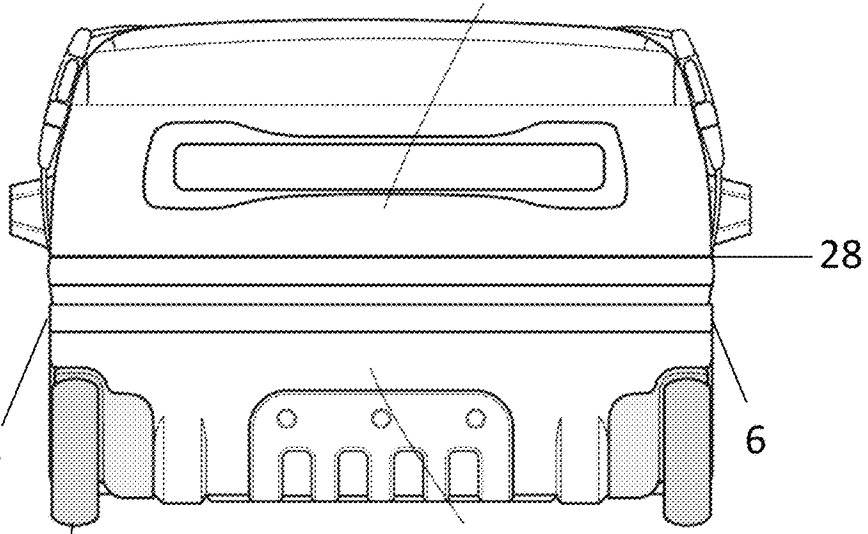
FIG. 6 shows a bottom view of the general assembly of FIG. 1.
Figure 5:
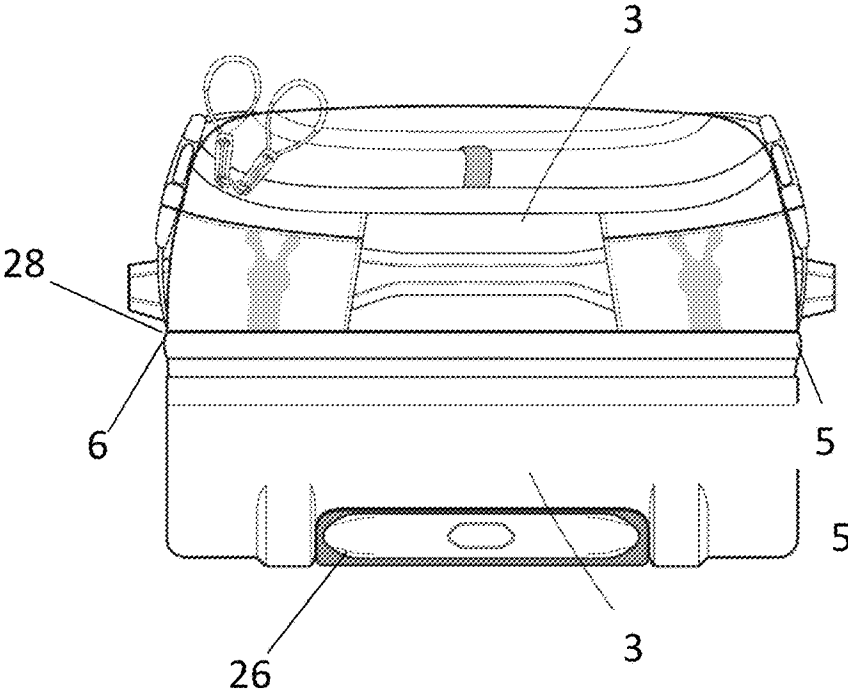
FIG. 5 shows a top view of the general assembly of FIG. 1.

Representative embodiments according to the inventive subject matter are shown in FIGS. 1-15 (the "Figures"), wherein the same or generally similar features share common reference numerals.

In some embodiments, the inventive subject matter is directed to an item of luggage having a plurality of sides sufficient to define a first volumetric space. An expandable section is disposed within the space between first and second opposing sides. At least the second opposing side defines a boundary for the volumetric space and provides an exterior surface for the item of luggage. The expandable section has a first configuration wherein it is stored within the space and has an expandable side that is adjacent to the first opposing side. It has a second configuration wherein the expandable side extends a predetermined distance from the first opposing side to define a boundary for a second volumetric space that is the same as or different from the first volumetric space.

The Figures show one of many possible examples of a luggage item that is consistent with the foregoing description. In this example, a luggage item 10 consists of a main luggage item 12 and an optional removable luggage item 14, such as a backpack, duffel bag or travel or brief case (hereinafter, the removable item will generally be referred to as a "pack" for the sake of convenience).

FIG. 1 shows front, left perspective views of a modular assembly of a main luggage item 12 and a removable item 14 coupled to the main luggage item, with the top arrow pointing to the removable item after being decoupled from the main item and the lower arrows indicating possible configurations of the main item following the decoupling of the main item. The lower arrow on the left shows the main item before the deployment of an expandable side 9. The lower arrow to the right shows the main luggage item after the deployment of the expandable section to define a volumetric configuration that is greater than the pre-deployment configuration indicated by the lower left arrow.

Figure 11B:
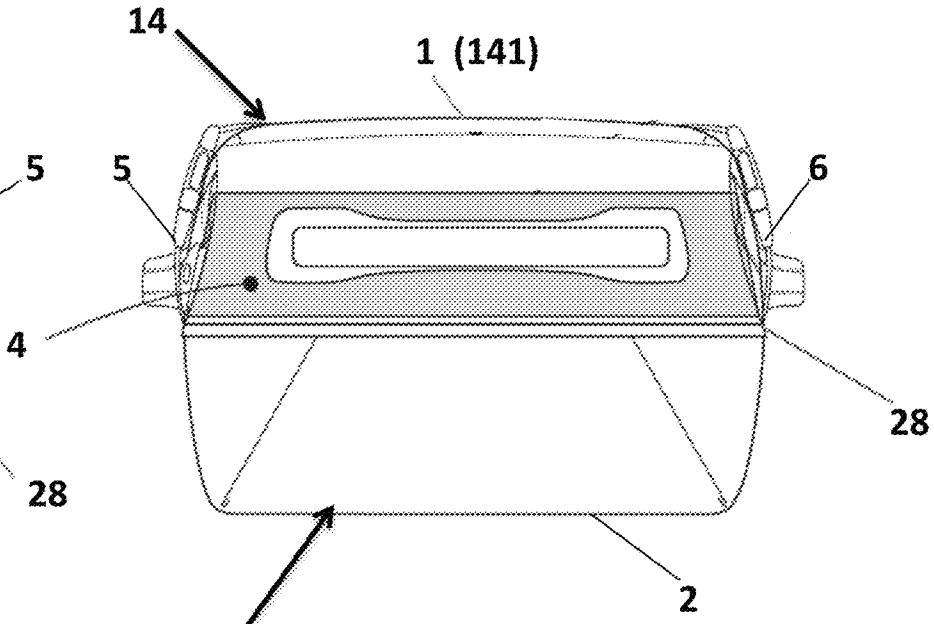
FIG. 11B shows a bottom view of the general main luggage item according to FIGS. 7A-7B, with the deployed expandable section.
Figure 11A:
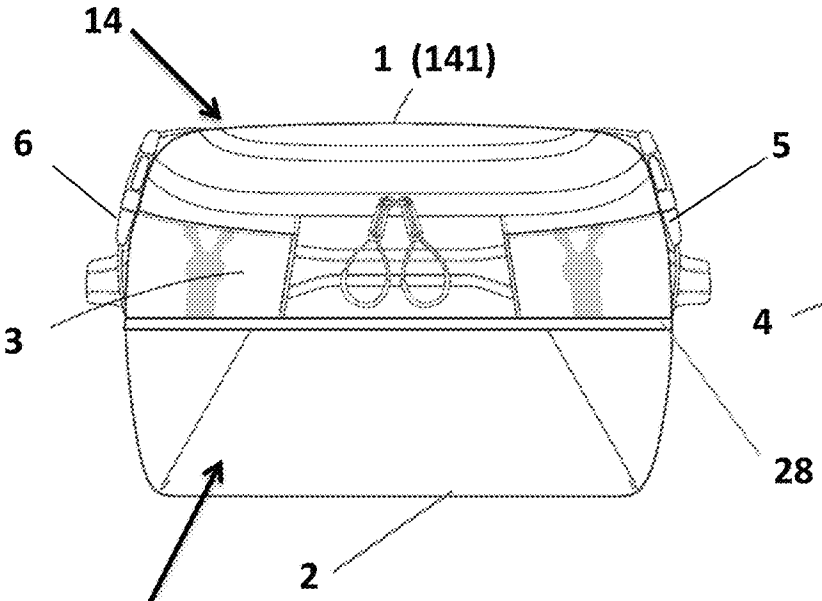
FIG. 11A shows a top view of the general main luggage item according to FIGS. 7A-7B, with the deployed expandable section.

The assembly 10 of luggage items provides an overall item that has a front side 1 and an opposing back side 2. The front and back sides are generally planar and they provide generally planar opposing boundaries that define an overall volumetric space for the interior compartment for the overall luggage item 10 and any intermediate subcompartments. In this example, the removable pack 14 provides the front side 1 of the overall (combined) luggage item 10. Referring to FIGS. 11A and 11B, the front side 1 of luggage item 10 has a front surface 141, which is the front surface of removable pack 14 and a back surface 2, which happens to be the back side of main luggage item 12. The back surface 142 of the removable pack faces the interior compartment 7 of the main luggage item 12. In some embodiments, the removable pack is designed to recede wholly or partially into compartment 7. In other embodiments, back surface 142 of the removable pack defines a generally planar boundary surface for the compartment. In yet other embodiments, back surface 142 may be concave so that it extends above compartment 7 adding to the volumetric space of that compartment. The front surface 141 of the pack is the front, exterior surface for the overall (combined) luggage item 10.

The overall luggage item 10 also has a top side 3, bottom side 4, left side 5 and right side 6, as well as front and back sides. In the example shown, each pair of front/back sides, top/bottom sides, and right/left sides are opposing sides. Each side has an exterior surface and an interior surface. The sides are the composite of the merged sides of main luggage item 12 and removable pack 14. (These same reference numerals also indicate the various sides of main luggage item 12 when the removable pack 14 is detached.) In some cases, the space between the exterior facing surface and the interior facing surface may be occupied with one or more plies of material and/or one or more sub-compartments or pockets, for example.

Luggage items, 10, 12 and 14 are not limited to having six sides; any one can have more or less sides. The overall luggage item 10 or any other item can also be in different shapes, not just rectilinear. For example, any item could be round like a hatbox or it could be pear shaped. FIG. 15 shows an example of a generally cylindrically shaped assembly 110 of a main luggage item 112 and removable item 114. Nor must any given side for an item be fully solid. For example, the top side could be left open-sided, or it could be partially sided, with an open-mesh material or a set of straps, for instance, extending across the space of the side.

As can be appreciated, a volumetric space can be defined by as few as two or more sides, and other boundaries for the volumetric space extrapolated from the two or more known sides. For instance, referring to the embodiment shown in the Figures, the general volumetric space for the interior compartment 7 of main luggage item 12 may be defined by looking at a combination of any two sides that are orthogonal to each other. These could be the top side or bottom side and any one of the right side or left side, for example. Alternatively, they could be the back side or front side and any one of the right, left, top, or bottom sides.

Figure 7B:
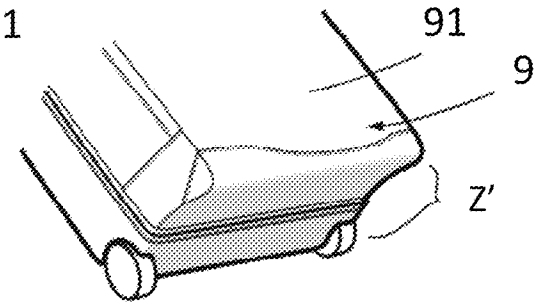
FIG. 7B is a perspective view of the bottom of the general main item of luggage from FIG. 7B showing the volumetric configuration of the deployed expandable section.
Figure 7A:
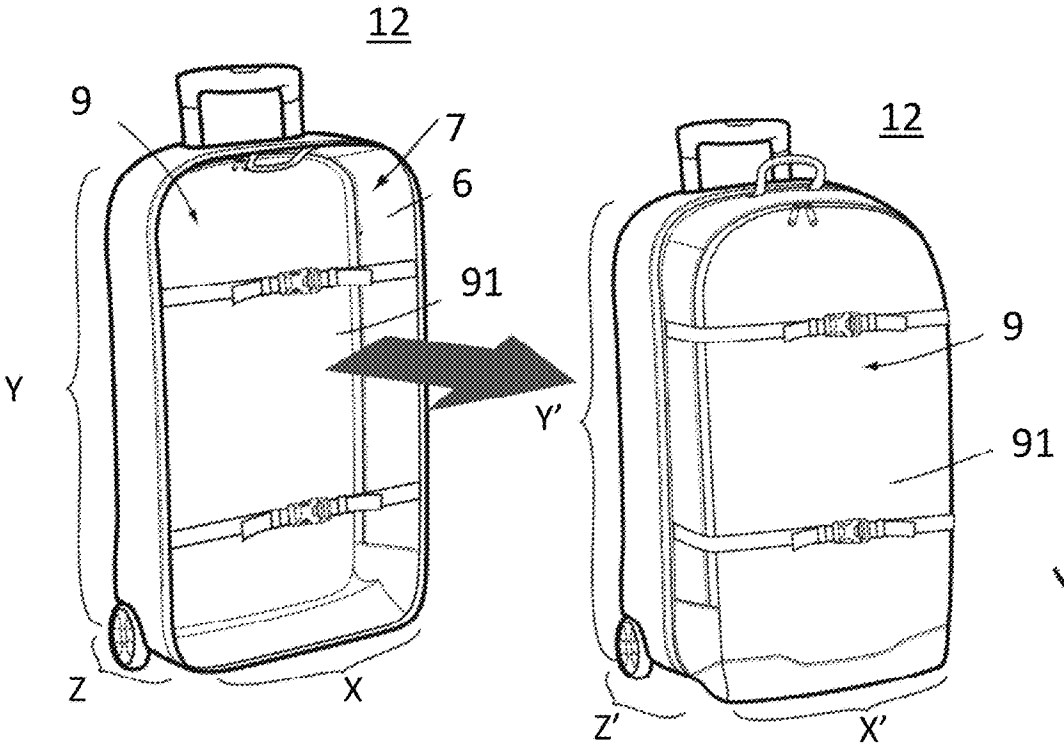
FIG. 7A shows configuration of the general main item in the assembly of FIG. 1 following decoupling from the removable item, with the arrow indicating the configuration of the main item following deployment of an expandable section stored in a compartment of the main item.

Looking at FIGS. 7A-7C, the compartment or volumetric space 7 for the main luggage item 12 has dimensions, generally indicated by the brackets of X (width), Y (height) and Z (depth), which also indicate the X, Y and Z axes for the item. The dimensions define the shape and volume of space for the storage compartment 7 for the main luggage item 12. When the removable pack 14 is removed, the expandable section 9 can be deployed from its first, stowed configuration within the interior of the compartment to a second deployed configuration that increases the Z dimension to a different dimension, Z', which may be greater or smaller than Z. In the embodiment shown Z' is greater than Z. Hence, the volume of the storage compartment 7 may be increased. It may be increased to any desired amount, limited only by the space necessary to store the expandable portion within the main luggage item. Suitable increases in the volumetric space of the storage compartment could be 25%, 33%, 40%, 50%, 66%, 75%, 100%, 125%, 150%, 175%, or 200%, for example.

In other embodiments, the expandable section 9 or 109 may consist of two or more sub-compartments. The sub-compartments could be arranged in a number of ways along the X, Y and/or Z axes. For example, they could be generally parallel and coextensive to each other along the Z axis, with each capable of independently expanding along the Z axis so that there are a plurality of volumetric shapes along that axis. Similarly, there may be a plurality of sub-compartments arranged along the X and/or Z axes that allow for a plurality of volumetric shapes along one or both such axes. The compartments, sub-compartments, and pockets in the expandable section, and any other section of the luggage item 10, may have zippers, snaps, drawstrings, hook and loop closures, buttons, etc. for accessing and securely storing things.

While the example presented illustrates a combination of luggage items, in some embodiments, a single luggage item is contemplated. For example, the removable luggage item 14 could be replaced by a non-removable panel portion that has front and back surfaces defining a front side of the luggage item, with the back surface facing the interior compartment and the front surface forming an exterior surface of the front side of the luggage item.

Further, if a removable luggage item 14 is part of an overall item of luggage 10, it may be positioned not only on the front side of the main item but on any other side as well. As noted above, the removable pack may occupy some or all the volume of compartment 7. If it occupies the entire volume its compartments between surfaces 141 and 142, the overall luggage item 10 may have an overall volumetric space that is about the same as or greater than that of compartment 7. The overall volumetric space for the overall luggage item 10 can essentially be the volumetric space of compartment 7 plus the volume added by the volumetric portion of removable item 14 that extends above compartment 7, but not double counting the volume of the removable item that recedes into compartment 7. Of course, some space may be lost to the arrangement of solid materials used in constructing the removable item.

Although the expandable section 9 is disposed between back and front sides, providing expandability along a Z-axis, it may be disposed between any other set of opposing sides. For example, it may be disposed between top and bottom sides 3, 4 and expandability would be along the Y-axis. Alternatively, it may be disposed between the left and right sides 5, 6 and expandability would be along the x-axis. Still further, the assembly of luggage item 10 and the expandable section 9 may be such that the expandable section has multiple sides and the luggage item may be expandable from a first position stored in the volumetric space for an interior compartment along any one or more of the X, Y, of Z axes.

In some embodiments, the expandable section 9 or 109 is permanently fixed to the luggage item, e.g., by sewing, mechanical fasteners, or chemical bonding. In other embodiments, it may be removable by use of zippers, snaps, buttons, etc.

Among the possibilities is for the expandable section to have an expandable side, e.g., side 91, that moves from a first configuration adjacent to any of the sides of the luggage item towards an opposite side or boundary for the luggage item and thereby into a second configuration. The expandable section 9 also may have fully or partially enclosed sides 93, 94, 95, and 96 connected at the periphery of front side 91 that extend parallel to the corresponding sides 3, 4, 5 and 6 of the luggage item. Sides 93 (top), 94 (bottom), 95 (left), and 96 (right) are perpendicular to back side 2 to which the expandable side 91 is adjacent and generally parallel.

The expandable section 9 may be made of any flexible material that is suitable for use as siding for a luggage item, such as woven fibers, knit fibers or non-woven flexible materials, such as TPU films, commingled fibers, or other flexible materials. It could also be made of relative rigid materials, such as thermoformed foams, polycarbonate, ABS, PP, PE, PA, or other plastics that are mechanically expandable. For example, an expandable side 91 of expandable section 9 could be a rigid sheet material that is connected at one or more points along its periphery to an expansion system, such as an accordion structure or a telescoping structure or inflatable bladders that form or are disposed at one or more of sides 93, 94, 95, and 96. The expandable section 9 could also be constructed of a combination of flexible and relatively rigid materials.

In some embodiments, the expandable section 9 is stored in a first configuration within the compartment 7 wherein one or more sides of the expandable section are parallel to and generally coextensive with a side of the item of luggage. For example, the Figures show a side 91 of the expandable section 9 that overlies the adjacent interior surface of the back side 2 of the main luggage item. In other embodiments, an expandable side could be less than coextensive with an adjacent side of the luggage item. For example, the expandable section 9 could be rolled or folded into a more discrete space within the compartment 7 and could be deployed to a second, expanded configuration by a user or through automatic mechanisms for deployment, e.g., spring, hinge, or inflation systems.

Figure 8B:
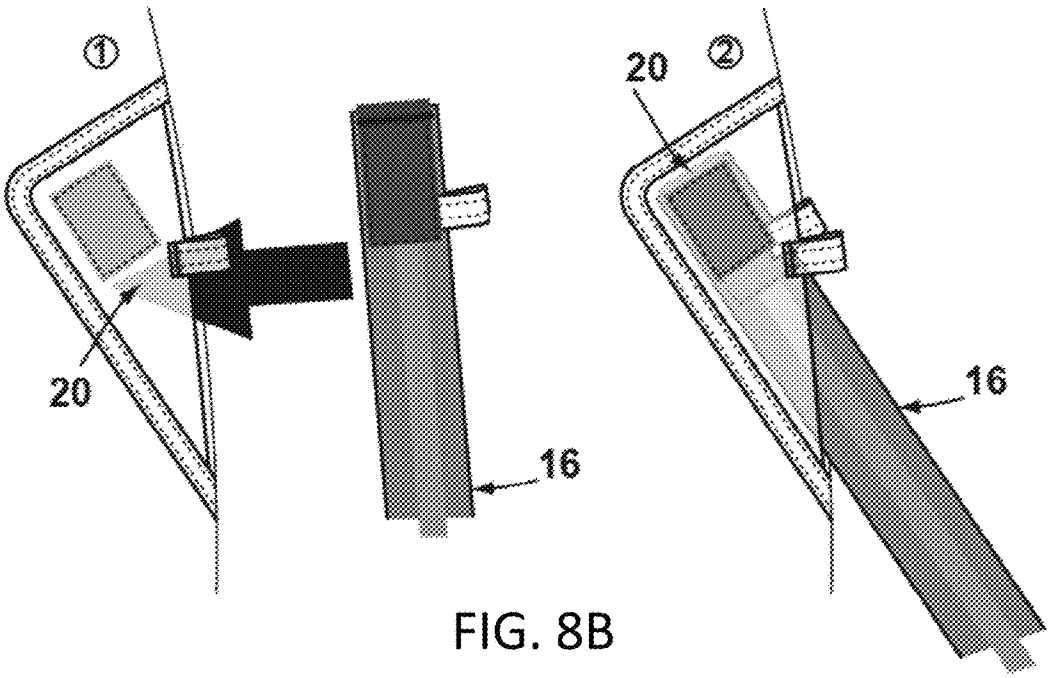
FIG. 8B shows details of a receiver associated with the general main luggage item of FIGS. 7A-7B for coupling to one end of a supporting stay, with the left side showing a removable stay decoupled from the receiver and the right side showing the stay coupled to the receiver.
Figure 8A:
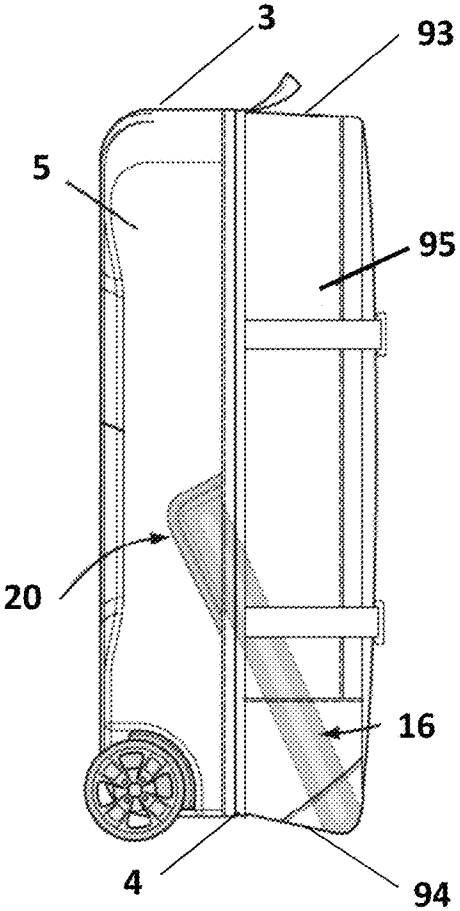
FIG. 8A shows a left side view of the general main luggage item of FIGS. 7A-7B with an optional supporting stay system associated with the main item and its expandable section, the stay being used to support the expanded section in a desired configuration.
Figure 8C:
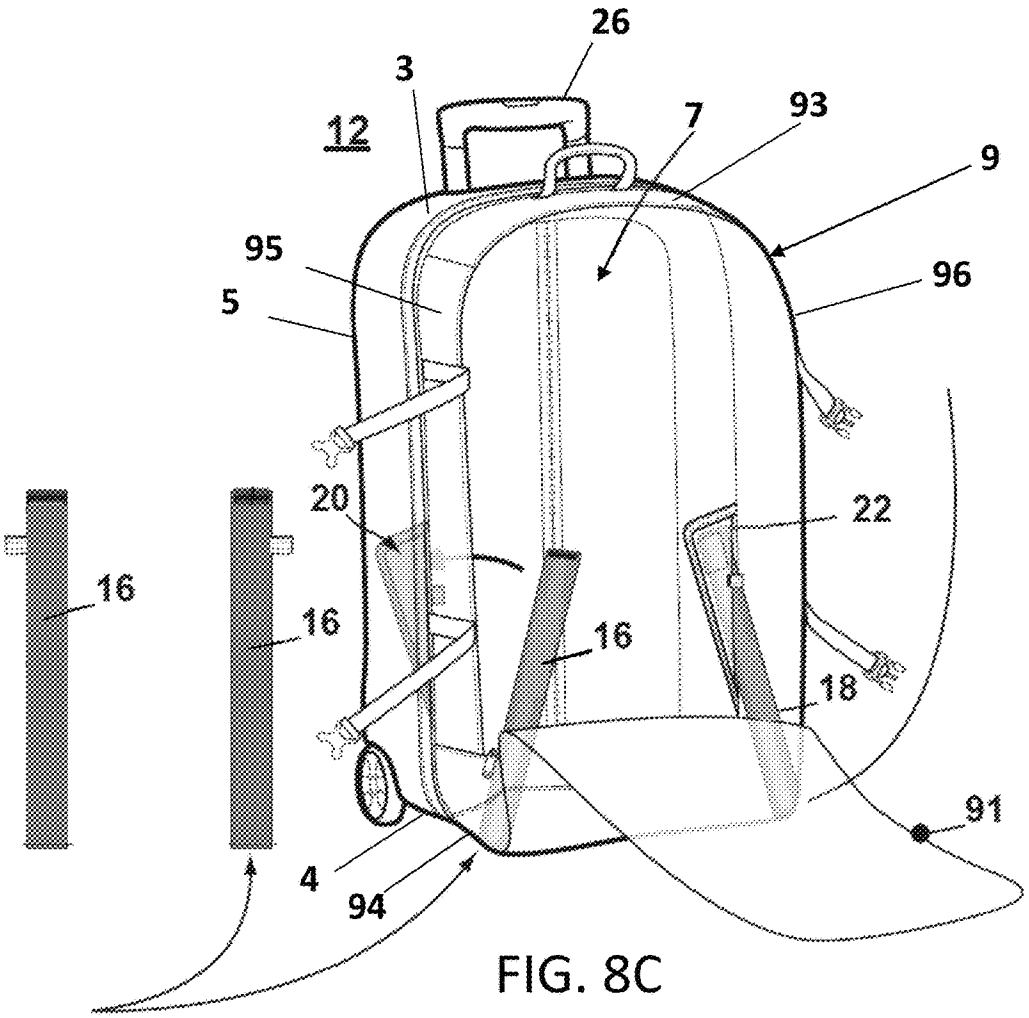
FIG. 8C shows further details of a stay system according to FIGS. 8A-8B.
Figures 12A, 12B, 12C:
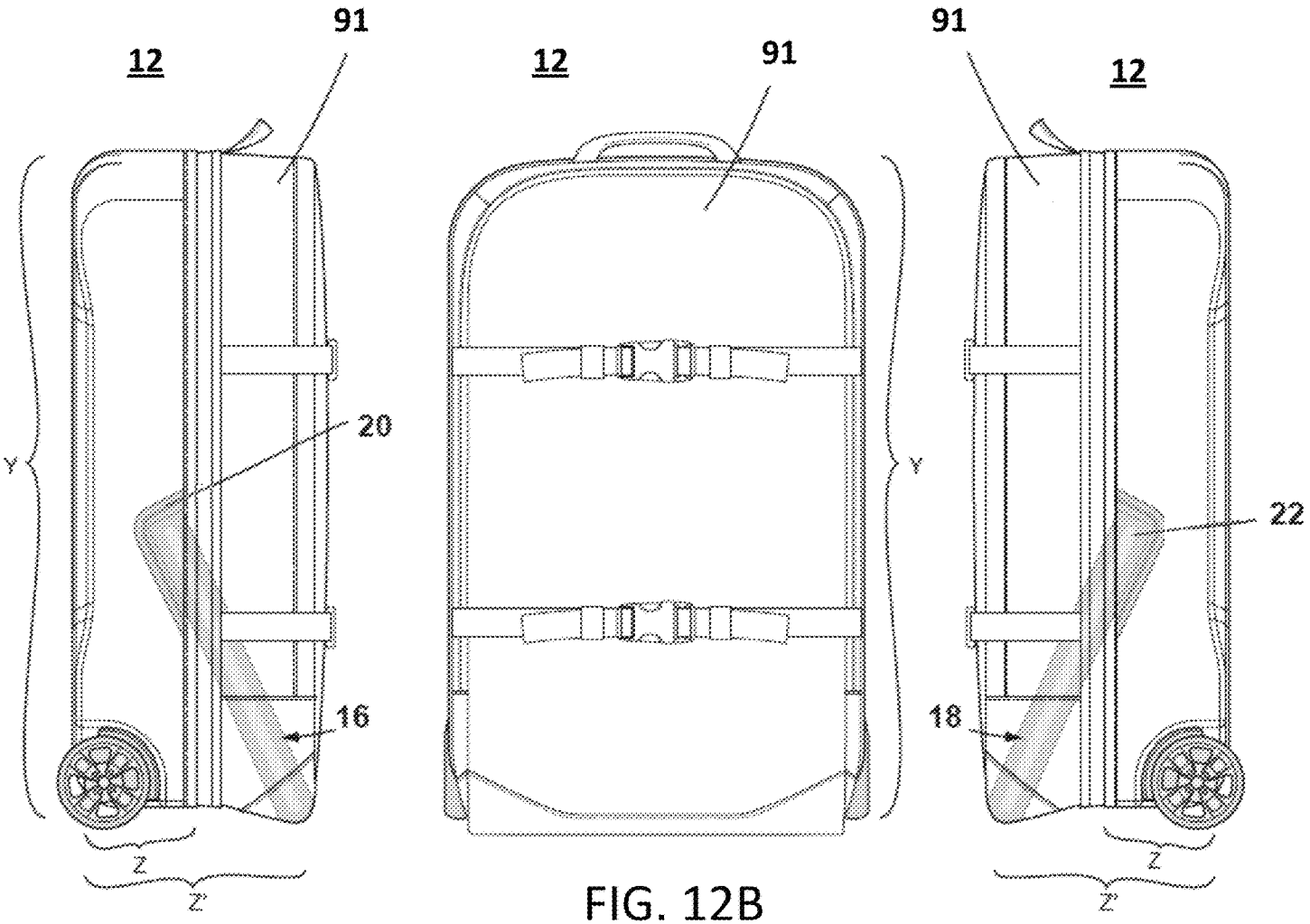
FIG. 12A shows a left side view of the general main luggage item according to FIGS. 7A-7B, with the deployed expandable section.
FIG. 12B shows a front side view of the general main luggage item according to FIGS. 7A-7B, with the deployed expandable section.
FIG. 12C shows a right side view of the general main luggage item according to FIGS. 7A-7B, with the deployed expandable section.
Figure 14B:
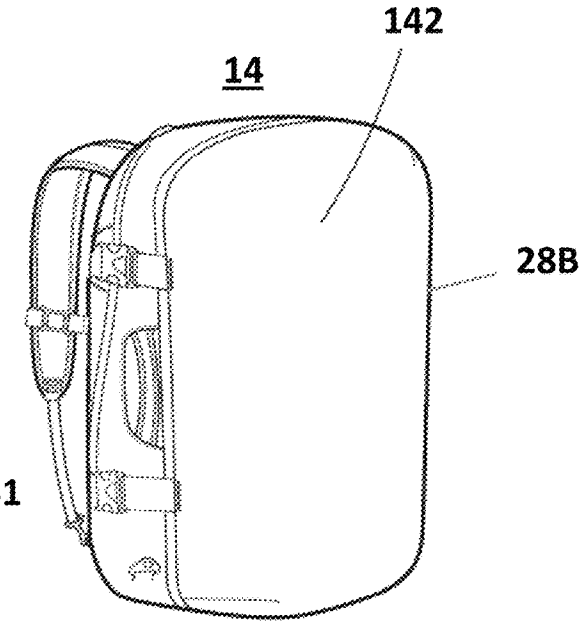
FIGS. 14A-B show the general modular assembly of luggage items of FIG. 1 with stowable shoulder straps on the removable item.
Figure 14A:
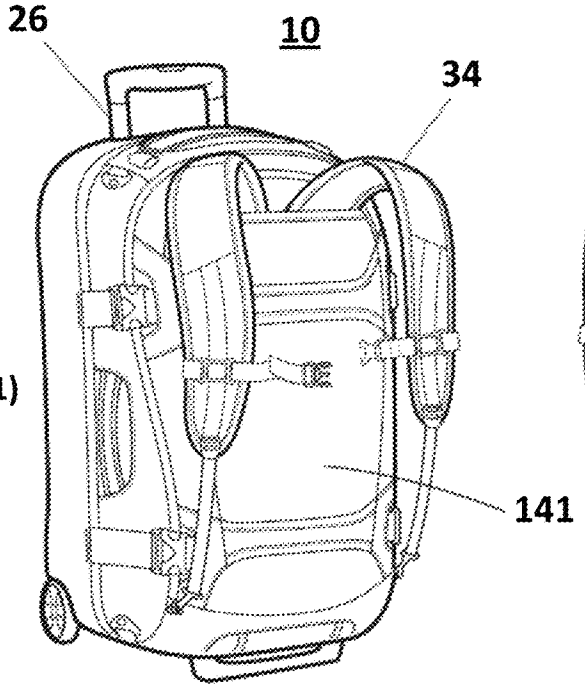
Figure 13:
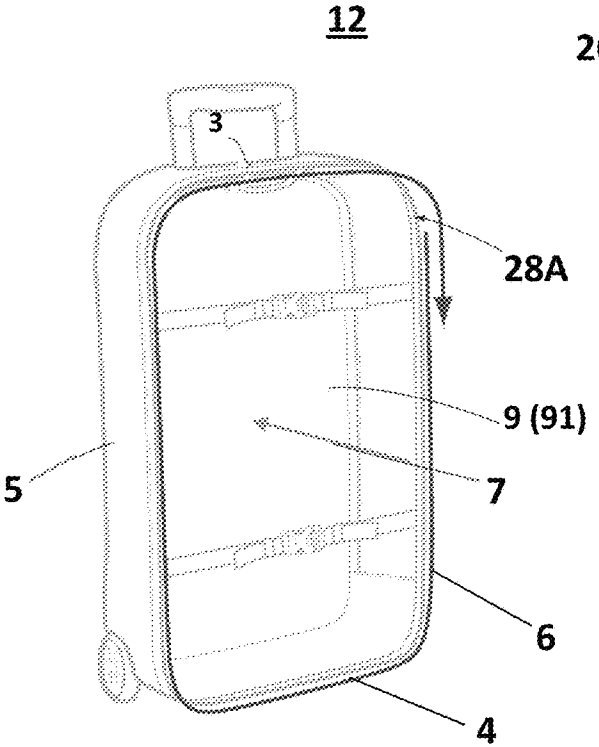
FIG. 13 shows the main luggage item with the arrow indicating a configuration for an associated coupling system for coupling the main luggage item to the removable item.

The luggage item 10 may include a stay or support system that supports some or all of the expandable section 9 in a desired form. FIGS. 8 and 12 show a pair of elongate, rigid elements 16 (left) and 18 (right), each having opposing ends. Looking at element 16 as representative, one end may be disposed in or mounted to a left side of the main item of luggage. From that end, the element angles outwardly and downwardly so that the opposite end extends beyond the boundary of the front, bottom side of the compartment 7 for the main luggage item 12. An opposite end is disposed on or mounted to or near the lower left corner of a flexible expandable section so as to tension the expandable section to the expanded Z' position (FIG. 12). The right side has a corresponding element that tensions the expandable section at its lower right corner. In the embodiment shown, a receiver, such as pockets 20, 22 on luggage item 10 are used to hold the top ends of the elements 16, 18 in place. The bottom ends may be hingeably disposed on the luggage item or placed in pockets similar to the top ends, for example. In short, the stay system extends into the second volumetric space intended for the expandable section and supports the expandable section in an intended configuration for defining the second volumetric space.

Other mechanisms that could be used to deploy expandable section 9 include other hinged structures, e.g., opposite ends of the elongate elements 16, 18 are disposed on the luggage item, and the hinge point is in between the opposing ends of the elongate elements 16, 18. Another option would be to use inflatable bladders that extend along the periphery of one or more sides of the expandable section, for example.

Figure 9:
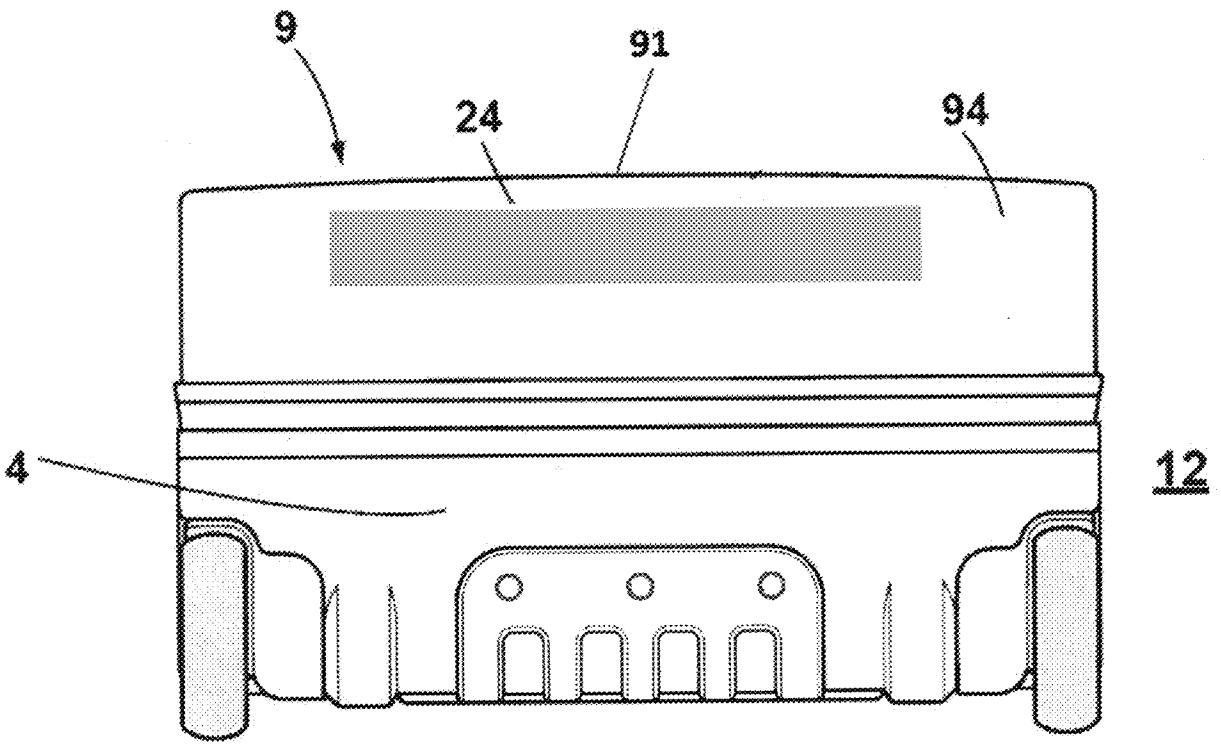
FIG. 9 shows a bottom view of the general main luggage item according to FIGS. 7A-7B with an alternative stay system associated with a bottom side of a deployed expandable section.
Figure 10:
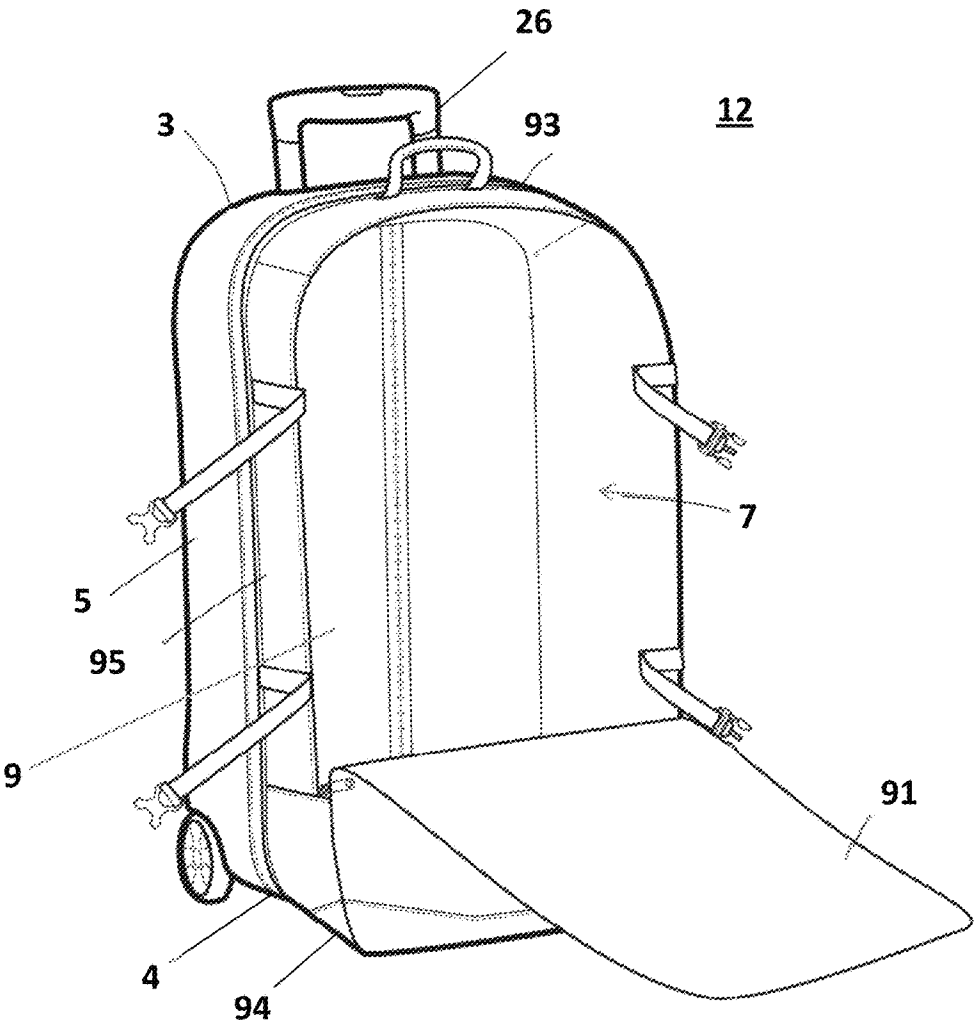
FIG. 10 shows details of an openable front side of the expandable section of the general main luggage item of FIGS. 7A-7B.

Additional stiffening or tensioning elements may be associated with the expandable section. For example, an elongate stiffening element 24 may be disposed or placed in the expandable section along the bottom section 94, between the left and right corners, as shown in FIG. 9, for example.

A luggage item according to the inventive principles may be configured with any number of other features to advance and supplement the inventive advantages. For example, as seen in the FIGS., the luggage item may optionally include fixed or telescoping poles 26 with a handgrip 30 on one or more of the telescoping poles. The luggage item may include wheels 32 for rolling the item. It may include one or more shoulder straps 34 so that the luggage item may be carried as a shoulder pack or bag or as a backpack. The luggage item may include storage compartments for stowing the strap. The luggage item may include one or more handgrips on the body of the item to facilitate carrying and handling of the luggage item. The luggage item may include any number or arrangement of sub-compartments and pockets in a similar fashion as described above for the expandable section.

One or more removable luggage items may be attached to a main luggage items using zipper systems having one or more complementary zipper tapes 28 (28A, 28B) mounted along a defined area on each item. The removable items may attach to the main luggage item in other ways, such as by straps, snaps, and other inter-engaging parts.

Figures 15A, 15B:
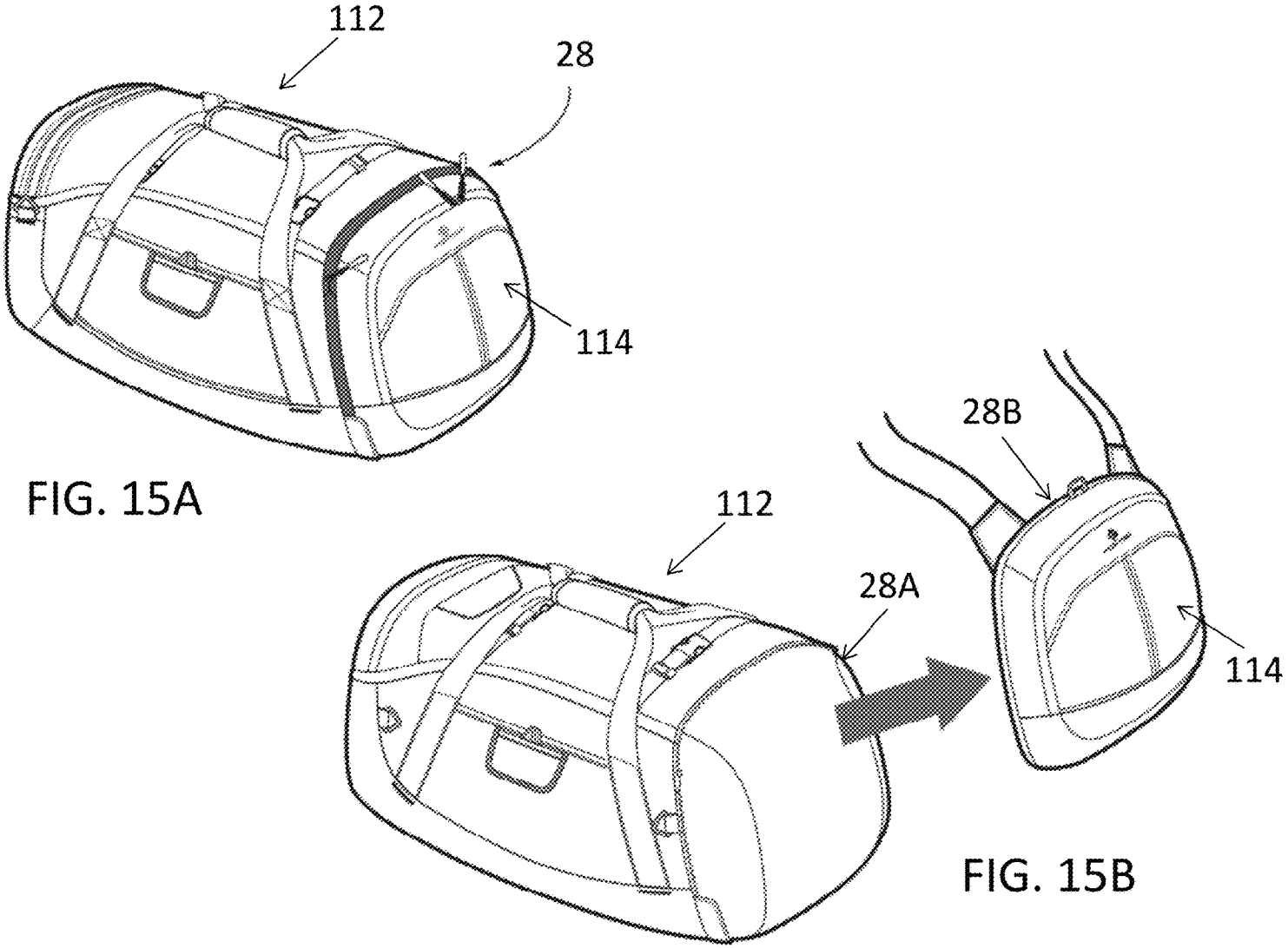
FIGS. 15A-15B show another example of an assembly of a main item of luggage in the form of a duffel bag with a removable item attached at one end, namely a shoulder bag, with FIG. 15A showing the items coupled together and FIG. 15B showing the items decoupled from one another.

FIGS. 15A-15B show another example of a modular assembly 110 of a main item 112 of luggage in the form of a duffel bag with a removable item 114 attached at one end, namely a shoulder bag that includes a shoulder strap. The bag and main luggage items may be coupled via a zipper system 128 (128A, 128B). FIG. 15B shows an expanded section 109, which is stored in a compartment at one end of the duffel bag, in an expanded condition following removal of the shoulder bag 114.

As used herein "adjacent" means directly adjacent or indirectly adjacent, i.e., there may be close spacing but separation by an intermediate layer of material or structure. As used herein, "couple" and variants of that word mean directly or indirectly connected or attached together.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

Any patent and non-patent literature cited herein is hereby incorporated by references in its entirety for all purposes.

The invention claimed is:

1. A method of making a modular set of luggage items, comprising:

providing a main luggage item with an expandable section and a stay system, or other support mechanism, having an elongate element extending from a first end to an opposed second end, providing a removable luggage item having a storage compartment, the main item comprising a plurality of sides sufficient to define a first volumetric space defining a first storage compartment, the expandable section having a first, stored configuration disposed within the first volumetric space between a first opposing side associated with the main luggage item and a second opposing side in opposed relationship relative to the first opposing side, the second opposing side comprising a side of the removable luggage item and defining a boundary for the first volumetric space, and the expandable section having an expandable side that is adjacent to the first opposing side in the stored configuration, and a second configuration wherein the expandable side extends a predetermined distance from the first opposing side to define a boundary for a second volumetric space defining a second storage compartment that is the same as or different in volume from the first volumetric space;

wherein one of the ends of the elongate element pivotably couples with at least one of the plurality of sides of the main luggage item and another portion of the elongate element removably couples with the expandable section to tension the expandable section toward the second configuration, and wherein the removable luggage item is configured to removably couple with the main luggage item.

2. The method according to claim 1, wherein the elongate element is further configured to urge the expandable side and the first opposing side apart from each other.

3. The method according to claim 1, wherein at least one of the plurality of sides of the main luggage item and/or the expandable section defines a receptacle configured to removably receive an end of the elongate element.

4. The method according to claim 3, wherein the at least one of the plurality of sides of the main luggage item comprises the expandable side.

5. An item of luggage, comprising:

a plurality of sides sufficient to define a first volumetric space, an expandable section disposed between first and second opposing ones of the plurality of sides, wherein at least the second opposing side defines a boundary for the first volumetric space;

a stay system, or other support mechanism, having a strut extending from a first end configured to pivotably couple with at least one of the plurality of sides of the main luggage item; and the expandable section having a first configuration wherein it is stored within the first volumetric space with an expandable side positioned adjacent to the first opposing side to define a first interior compartment between the second opposing side and the expandable side, and a second configuration wherein the expandable side extends a predetermined distance from the first opposing side to define a boundary for a second volumetric space defining a second interior compartment, wherein the second opposing side is configured to be removably coupleable with the first opposing side and the strut is further configured to urge the expandable section to the second configuration via a coupling of the strut to the expandable section.

6. The luggage item of claim 5, wherein a volume of the second volumetric space is at least 25% greater than a volume of the first volumetric space.

7. The luggage item of claim 5, wherein a volume of the second volumetric space is at least 50% greater than a volume of the first volumetric space.

8. The luggage item of claim 5, wherein a volume of the second volumetric space is at least 100% greater than a volume of the first volumetric space.

9. The item of luggage according to claim 5, wherein the strut is configured to removably couple with the expandable section so as to urge the expandable side and the first opposing side apart from each other.

10. The item of luggage according to claim 5, wherein the at least one of the plurality of sides of the main luggage item defines a receptacle configured to removably receive an end of the strut.

11. A luggage item, comprising:

a first wall and a second wall positioned in opposed relationship relative to each other;

an expandable member positioned between the first wall and the second wall, wherein the expandable member is positioned adjacent the first wall in a stowed configuration and spaced apart from the first wall in an expanded configuration;

a stay system, or other support mechanism, having an elongate stay wherein one of the ends of the elongate stay pivotably couples with at least one of a plurality of sidewalls of the luggage item and another portion of the elongate element removably couples with the expandable section to tension the expandable section toward the expanded configuration; and a first coupler associated with the first wall and a second coupler associated with the second wall, wherein the first coupler and the second coupler are complementarily configured to provide a decoupleable coupling between the first wall and the second wall, wherein a first volumetric space between the expandable member in the stowed configuration and the second wall defines a first interior compartment and a second volumetric space between the expandable member and the first wall defines a second interior compartment equivalently sized or larger than the first interior compartment when the expandable member is in the expanded configuration.

12. The luggage item of claim 11, wherein a sidewall extends from a periphery of the first wall and the first coupler is positioned on the first sidewall in spaced-apart relation to the first wall.

13. The luggage item of claim 12, where the second wall is spaced apart from the edge of one of the sidewalls such that a volume of the first interior compartment is greater than a volumetric space defined by the first wall and the sidewall extending therefrom.

14. The luggage item of claim 11, wherein a sidewall extends from a periphery of the first wall to define an edge spaced apart from the first wall and the expandable member is configured to expand beyond the edge in the expanded configuration.

15. The luggage item of claim 11, wherein, in the expanded configuration and when the decoupleable coupling is decoupled, the expandable member defines a surface spaced farther apart from the first wall than the second wall is spaced from the first wall when the decoupleable coupling couples the first wall and the second wall together.

16. The luggage item of claim 11, wherein the luggage item comprises a main luggage item and a removable luggage item, wherein the first wall comprises a wall of the main luggage item and the second wall comprises a wall of the removable luggage item.

17. The luggage item of claim 16, wherein the removable luggage item is the smaller of the items and includes at least one shoulder strap.

18. The luggage item of claim 17, wherein the at least one shoulder strap comprises a first backpack strap, the removable item further including a second backpack strap.

19. The luggage item of claim 16, wherein the expandable member comprises a flexible material.

20. The luggage item of claim 16, wherein the decoupleable coupler comprises a zipper.

21. The luggage item of claim 16, wherein the first volumetric space is defined by two or more sides of the main luggage item and the second wall.

22. The luggage item of claim 11, wherein the luggage item comprises a main luggage item and a removable item each having a plurality of sides, wherein the first wall defines a side of the main item and the second wall defines a side of the removable item.

23. The luggage item of claim 22, wherein the removable item comprises a third wall spaced apart from the second wall and positioned between the first wall and the second wall when the decoupleable coupler couples the first wall and the second wall together.

24. The luggage item of claim 23, wherein the third wall is positioned adjacent the expandable member in the stowed configuration.

* * * * *